US010038289B2

(12) United States Patent
Netsu

(10) Patent No.: US 10,038,289 B2
(45) Date of Patent: Jul. 31, 2018

(54) CONVERSION DEVICE

(71) Applicant: SEIKO EPSON CORPORATION, Tokyo (JP)

(72) Inventor: Takahiro Netsu, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 6 days.

(21) Appl. No.: 15/405,721

(22) Filed: Jan. 13, 2017

(65) Prior Publication Data

US 2017/0222546 A1 Aug. 3, 2017

(30) Foreign Application Priority Data

Feb. 2, 2016 (JP) ..... 2016-017721

(51) Int. Cl.
*H01R 31/06* (2006.01)

(52) U.S. Cl.
CPC ..... *H01R 31/065* (2013.01)

(58) Field of Classification Search
CPC ..... H02M 3/04; H01R 24/60; H01R 2107/00; H01R 31/065
See application file for complete search history.

(56) References Cited

U.S. PATENT DOCUMENTS

2016/0139642 A1* 5/2016 Hijazi ..... G06F 1/26 361/679.31
2016/0202743 A1* 7/2016 Li ..... G06F 1/26 710/313
2016/0335222 A1* 11/2016 Schnell ..... G06F 13/4286
2017/0102736 A1* 4/2017 Peng ..... G06F 1/1632

OTHER PUBLICATIONS

From website USB Type-C Cable and Connector Specification; http://www.usb.org/developers/usbtypec/, USB Type-C Engineering Change Notice; Debug Accessory Appendix.
From website USB Type-C Cable and Connector Specification; http://www.usb.org/developers/usbtypec/, USB Type-C Engineering Change Notice; Correction for Attached.SNK.
From website USB Type-C Cable and Connector Specification; http://www.usb.org/developers/usbtypec/, USB Type-C Engineering Change Notice; Change plug overmold length from MAX to REF.
From website USB Type-C Cable and Connector Specification; http://www.usb.org/developers/usbtypec/, USB Type-C Engineering Change Notice; Removal of Proprietary Charging Methods.
From website USB Type-C Cable and Connector Specification; http://www.usb.org/developers/usbtypec/, USB Type-C Engineering Change Notice; Source VCONN Discharge.
From website USB Type-C Cable and Connector Specification; http://www.usb.org/developers/usbtypec/, USB Type-C Engineering Change Notice; USB Type-C ECR on the SRC-to-TrySRC looping.

(Continued)

*Primary Examiner* — Jue Zhang

(57) ABSTRACT

A conversion device is configured to include a first connection port that is a connection port of a USB Type C; a second connection port that is a connection port of a USB other than the USB Type C; a third connection port that is a connection port of a power supplying wire; a communication wire that is connected to a communication line between the first connection port and the second connection port; and a power wire that is connected to a power line between the first connection port and the third connection port.

6 Claims, 5 Drawing Sheets

(56) References Cited

OTHER PUBLICATIONS

From website USB Type-C Cable and Connector Specification; http://www.usb.org/developers/usbtypec/, USB Type-C Engineering Change Notice; USB 2.0 Type-C receptacle.
From website USB Type-C Cable and Connector Specification; http://www.usb.org/developers/usbtypec/, USB Type-C Engineering Change Notice; D+/D− DC Resistance.
From website USB Type-C Cable and Connector Specification; http://www.usb.org/developers/usbtypec/, USB Type-C Engineering Change Notice; VBUS Coupling.
From website USB Type-C Cable and Connector Specification; http://www.usb.org/developers/usbtypec/, USB Type-C Engineering Change Notice; USB Type-C ECR VConn Requirements.
From website USB Type-C Cable and Connector Specification; http://www.usb.org/developers/usbtypec/, USB Type-C Engineering Change Notice; Multi-port Chargers.
From website USB Type-C Cable and Connector Specification; http://www.usb.org/developers/usbtypec/, USB Type-C Engineering Change Notice; Try.SNK and Try.SRC usage recommendations.
From website USB Type-C Cable and Connector Specification; http://www.usb.org/developers/usbtypec/, USB Type-C Engineering Change Notice; USB 2.0 Hubs with Type-C Connectors.
From website USB Type-C Cable and Connector Specification; http://www.usb.org/developers/usbtypec/, USB Type-C Engineering Change Notice; VConn for Power Adapters.
From website USB Type-C Cable and Connector Specification; http://www.usb.org/developers/usbtypec/, Universal Serial Bus Type-C Locking Connector Specification; Revision 1.0; Mar. 9, 2016.
From website USB Type-C Cable and Connector Specification; http://www.usb.org/developers/usbtypec/, Universal Serial Bus Type-C Locking Connector Specification; Comparison of Revision 1.1; Apr. 3, 2015 and Revision 1.2, Mar. 25, 2016.
From website USB Type-C Cable and Connector Specification; http://www.usb.org/developers/usbtypec/, Universal Serial Bus Type-C Locking Connector Specification; Revision 1.2; Mar. 25, 2016.
From website USB Type-C Cable and Connector Specification; http://www.usb.org/developers/usbtypec/, Universal Serial Bus 3.1 Specification; Revision 1.0; Repeaters.
From website USB Type-C Cable and Connector Specification; http://www.usb.org/developers/usbtypec/, USB 3.1 Specification; Welcome Message, Oct. 1, 2014.
From website USB Type-C Cable and Connector Specification; http://www.usb.org/developers/usbtypec/, USB 3.0 Adopters Agreement.
From website USB Type-C Cable and Connector Specification; http://www.usb.org/developers/usbtypec/, Universal Serial Bus 3.1 Specification; Revision 1.0; Jul. 26, 2013.
From website USB Type-C Cable and Connector Specification; http://www.usb.org/developers/usbtypec/, On-The-Go and Embedded Host Supplement to the USB Revision 3.0 Specification, Revision 1.1, May 10, 2012.
USB Type-C Cable and Connector Specification; http://www.usb.org/developers/usbtypec/.
From website USB Type-C Cable and Connector Specification; http://www.usb.org/developers/usbtypec/, Inter-Chip Supplement to the USB, Revision 3.0 Specification, Revision 1.02, May 19, 2014.
From website USB Type-C Cable and Connector Specification; http://www.usb.org/developers/usbtypec/, Inter-Chip Supplement to the USB, Revision 3.0 Specification, Comparison of Revision 1.02 and 1.01, May 2014.
From website USB Type-C Cable and Connector Specification; http://www.usb.org/developers/usbtypec/, USB 3.1 Engineering Change Notice; TSEQ SKP Insertion Interval.
From website USB Type-C Cable and Connector Specification; http://www.usb.org/developers/usbtypec/, USB 3.1 Engineering Change Notice; Loopback BERT.
From website USB Type-C Cable and Connector Specification; http://www.usb.org/developers/usbtypec/, USB 3.1 Engineering Change Notice; Reference Clock Reqs.
From website USB Type-C Cable and Connector Specification; http://www.usb.org/developers/usbtypec/, USB 3.1 Engineering Change Notice; Loss Budget Clarification.
From website USB Type-C Cable and Connector Specification; http://www.usb.org/developers/usbtypec/, USB 3.1 Engineering Change Notice; Rx JTOL RJ Correction.
From website USB Type-C Cable and Connector Specification; http://www.usb.org/developers/usbtypec/, USB 3.1 Engineering Change Notice; USB3.1 U3/U2 TX Common Mode Specification.
From website USB Type-C Cable and Connector Specification; http://www.usb.org/developers/usbtypec/, USB 3.1 Engineering Change Notice; USB3.1 SCD Clarifications.
From website USB Type-C Cable and Connector Specification; http://www.usb.org/developers/usbtypec/, USB 3.1 Engineering Change Notice; TSEQ Clarification.
From website USB Type-C Cable and Connector Specification; http://www.usb.org/developers/usbtypec/, USB 3.1 Engineering Change Notice; Retimer PTM.
From website USB Type-C Cable and Connector Specification; http://www.usb.org/developers/usbtypec/, USB 3.1 Engineering Change Notice; Rx High Z measurement.
From website USB Type-C Cable and Connector Specification; http://www.usb.org/developers/usbtypec/, USB 3.1 Engineering Change Notice; Rx High Z Value.
From website USB Type-C Cable and Connector Specification; http://www.usb.org/developers/usbtypec/, USB 3.1 Engineering Change Notice; Gen 1 AC Coupling.
From website USB Type-C Cable and Connector Specification; http://www.usb.org/developers/usbtypec/, USB 3.1 Engineering Change Notice; Tx RJ Measurement Point.
From website USB Type-C Cable and Connector Specification; http://www.usb.org/developers/usbtypec/, USB 3.1 Engineering Change Notice; LFPS Typos.
From website USB Type-C Cable and Connector Specification; http://www.usb.org/developers/usbtypec/, USB 3.1 Engineering Change Notice; USB 3.1 CTLE.
From website USB Type-C Cable and Connector Specification; http://www.usb.org/developers/usbtypec/, USB 3.1 Engineering Change Notice; HSEQ.
From website USB Type-C Cable and Connector Specification; http://www.usb.org/developers/usbtypec/, USB 3.1 Engineering Change Notice; USB 3.1 wHubDelay.
From website USB Type-C Cable and Connector Specification; http://www.usb.org/developers/usbtypec/, USB 3.1 Engineering Change Notice; USB 3.1 LTM.
From website USB Type-C Cable and Connector Specification; http://www.usb.org/developers/usbtypec/, USB 3.1 Engineering Change Notice; Polling LFPS.
From website USB Type-C Cable and Connector Specification; http://www.usb.org/developers/usbtypec/, USB 3.1 Engineering Change Notice; USB 3.1 PTM Value.
From website USB Type-C Cable and Connector Specification; http://www.usb.org/developers/usbtypec/, USB 3.1 Engineering Change Notice; SKP OS Bytes During Compliance Clarification.
From website USB Type-C Cable and Connector Specification; http://www.usb.org/developers/usbtypec/, USB 3.1 Engineering Change Notice; USB3.1 SKP Ordered Set Definition.
From website USB Type-C Cable and Connector Specification; http://www.usb.org/developers/usbtypec/, USB 3.1 Engineering Change Notice; SLC IS SDS.
From website USB Type-C Cable and Connector Specification; http://www.usb.org/developers/usbtypec/, USB 3.1 Engineering Change Notice; SSP ping.LFPS tRepeat Requirement.
From website USB Type-C Cable and Connector Specification; http://www.usb.org/developers/usbtypec/, USB 3.1 Engineering Change Notice; SSP System Jitter Budget.
From website USB Type-C Cable and Connector Specification; http://www.usb.org/developers/usbtypec/, USB 3.1 Engineering Change Notice; USB3.1 tHubDriveResume.

(56) References Cited

OTHER PUBLICATIONS

From website USB Type-C Cable and Connector Specification; http://www.usb.org/developers/usbtypec/, USB 3.1 Engineering Change Notice; TSEQ Gen2 Clarification.
From website USB Type-C Cable and Connector Specification; http://www.usb.org/developers/usbtypec/, USB 3.1 Engineering Change Notice; Vbus 5V Nominal Range.
From website USB Type-C Cable and Connector Specification; http://www.usb.org/developers/usbtypec/, USB 3.1 Engineering Change Notice; USB 3.1 VBUS Max Limit.
From website USB Type-C Cable and Connector Specification; http://www.usb.org/developers/usbtypec/, Universal Serial Bus Type-C Authentication Specification, Revision 1.0, Mar. 25, 2016.
From website USB Type-C Cable and Connector Specification; http://www.usb.org/developers/usbtypec/, USB 3.1 Device Class Specification for Debug Devices, Revision 1.0, Jul. 14, 2015.
From website USB Type-C Cable and Connector Specification; http://www.usb.org/developers/usbtypec/, Universal Serial Bus Type-C(TM) Port Controller Interface Specification, Comparison of Revision 1.0 and Reivsion 1.0, Version 1.1, Jul. 20, 2016.
From website USB Type-C Cable and Connector Specification; http://www.usb.org/developers/usbtypec/, Universal Serial Bus Type-C(TM) Port Controller Interface Specification, Revision 1.0, Version 1.1, Jul. 20, 2016.
From website USB Type-C Cable and Connector Specification; http://www.usb.org/developers/usbtypec/, USB Power Delivery Engineering Change Notice; Applicability of Messages.
From website USB Type-C Cable and Connector Specification; http://www.usb.org/developers/usbtypec/, USB Power Delivery Engineering Change Notice; Remove PD and USB bcdDevice association.
From website USB Type-C Cable and Connector Specification; http://www.usb.org/developers/usbtypec/, USB Power Delivery Engineering Change Notice; DRP and DRD bits in SrcCap and SnkCap messages.
From website USB Type-C Cable and Connector Specification; http://www.usb.org/developers/usbtypec/, USB Power Delivery Engineering Change Notice; iCapChange Removal.
From website USB Type-C Cable and Connector Specification; http://www.usb.org/developers/usbtypec/, USB Power Delivery Engineering Change Notice; Sink No Response Timer.
From website USB Type-C Cable and Connector Specification; http://www.usb.org/developers/usbtypec/, USB Power Delivery Engineering Change Notice; Source State Diagram.
From website USB Type-C Cable and Connector Specification; http://www.usb.org/developers/usbtypec/, USB Power Delivery Engineering Change Notice; Language Relating to VDM Commands.
From website USB Type-C Cable and Connector Specification; http://www.usb.org/developers/usbtypec/, USB Power Delivery Engineering Change Notice; vSafe5V Voltage Range Clarification.
From website USB Type-C Cable and Connector Specification; http://www.usb.org/developers/usbtypec/, USB Power Delivery Engineering Change Notice; USB PD Wait Timing.
From website USB Type-C Cable and Connector Specification; http://www.usb.org/developers/usbtypec/, USB Power Delivery Engineering Change Notice; PD2.0 Externally Powered becomes Unconstrained Power.
From website USB Type-C Cable and Connector Specification; http://www.usb.org/developers/usbtypec/, USB Power Delivery Engineering Change Notice; PD2.0 Unexpected message received in PE_Ready state.
From website USB Type-C Cable and Connector Specification; http://www.usb.org/developers/usbtypec/, USB Power Delivery Specification Amendment; Jul. 9, 2012.
From website USB Type-C Cable and Connector Specification; http://www.usb.org/developers/usbtypec/, Universal Serial Bus Power Delivery Specification, Revision 2.0, V1.2, Mar. 25, 2016, + ECNs Aug. 2, 2016.
From website USB Type-C Cable and Connector Specification; http://www.usb.org/developers/usbtypec/, Universal Serial Bus Power Delivery Specification, Comparison of Revision 2.0, V1.2, Mar. 25, 2016 and Revision 2.0, V1.2, Mar. 25, 2016 + ECNs Aug. 2, 2016.
From website USB Type-C Cable and Connector Specification; http://www.usb.org/developers/usbtypec/, USB Type-C Engineering Change Notice; Audio Adapter State Change.

* cited by examiner

CONVERSION DEVICE

BACKGROUND

1. Technical Field

The present invention relates to a conversion device.

2. Related Art

In the related art, a universal serial bus (USB) standard defines various types. Recently, a standard which is called the USB Type C (refer to USB Type-C Cable and Connector Specification (searched on Dec. 28, 2015), Internet (URL: http://www.usb.org/developers/usbtypec/)) is defined and is begun to spread.

If a standard incompatible with the existing standard is defined, an apparatus supporting only one standard cannot be used as an apparatus supporting only another standard.

SUMMARY

An advantage of some aspects of the invention is to provide a technology of securing compatibility between a plurality of standards.

According to one aspect of the invention, there is provided a conversion device including a first connection port that is a connection port of a USB Type C; a second connection port that is a connection port of a USB other than the USB Type C; a third connection port that is a connection port of a power supplying wire; a communication wire that is connected to a communication line between the first connection port and the second connection port; and a power wire that is connected to a power line between the first connection port and the third connection port.

That is, the conversion device can be connected to a wire of the USB Type C by the first connection port, a wire of the USB standard other than the USB Type C by the second connection port, and a power supplying wire by the third connection port. Hence, wires of the USB standards of two types different from each other can be connected to the conversion device, and the power supplying wire can be connected to the conversion device.

In addition, since the communication wire included in the conversion device is connected to the communication line between the first connection port and the second connection port, the communication lines according to the USB Type C and the USB other than the USB Type C which are connected to each connection port are connected to each other by the conversion device. Since the power wire included in the conversion device is connected to the power line between the first connection port and the third connection port, the power lines according to the USB Type C and the USB other than the USB Type C which are connected to each connection port are connected to each other by the conversion device.

As a result, a communication line and a power line branch from the USB Type C connected to the first connection port, and the conversion device can communicate with the USB other than the USB Type C connected to the second connection port and can supply power to an electronic apparatus connected to the third connection port. Hence, the conversion device can communicate between an electronic apparatus which is connected by the USB Type C and an electronic apparatus which is connected by the USB other than USB Type C. In addition, the conversion device can transmit and receive power between an electronic apparatus which is connected by the USB Type C and an electronic apparatus which is connected to the third connection port.

For this reasons, it is possible to secure compatibility between a plurality of standards.

BRIEF DESCRIPTION OF THE DRAWINGS

The invention will be described with reference to the accompanying drawings, wherein like numbers reference like elements.

DESCRIPTION OF EXEMPLARY EMBODIMENTS

Here, embodiments of the invention will be described according to the following order.

(1) Usage Aspect of Conversion Device (1-1) Configuration of Conversion Device (2) Processing of Control Circuit (3) Another Embodiment

(1) Usage Aspect of Conversion Device

Figure 1A:
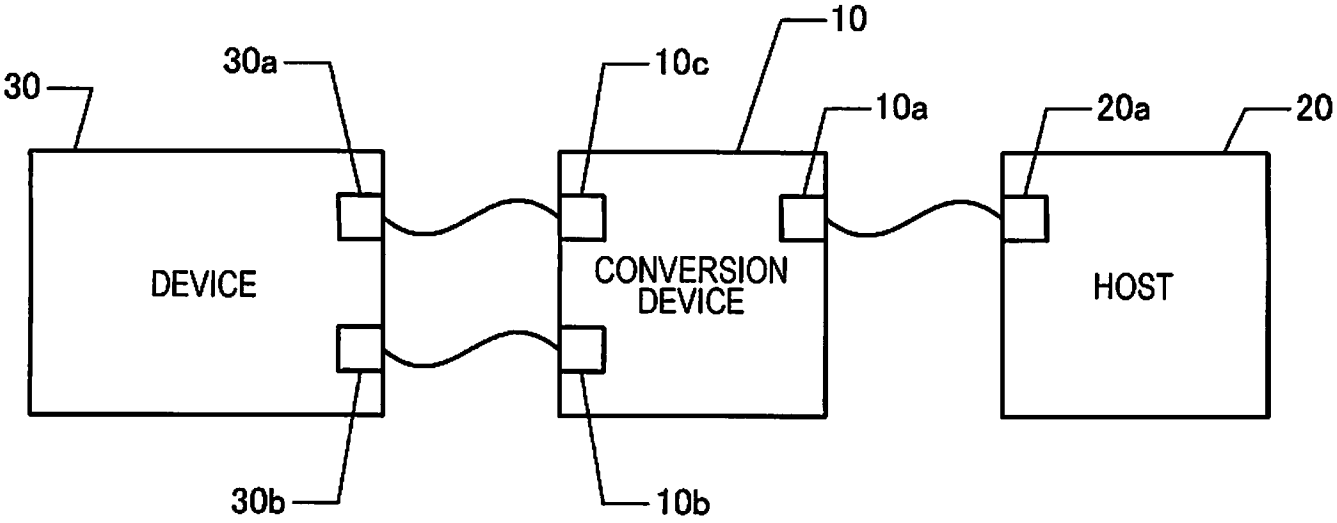
FIG. 1A is an explanatory diagram illustrating a usage aspect of a conversion device according to an embodiment of the invention.

FIG. 1A is an explanatory diagram illustrating a usage aspect of a conversion device 10 according to an embodiment of the invention. The conversion device 10 according to the present embodiment is connected to a host 20 and a device 30. The conversion device 10 is connected to the host 20 according to a standard of USB Type C. That is, the conversion device 10 includes a first connection port 10*a* which is a connection port of the USB Type C, and the host 20 includes a connection port 20*a* of the USB Type C. Hence, one connector of the USB Type C which is included in a wire of the USB Type C is connected to the first connection port 10*a*, and the other connector is connected to the connection port 20*a*, and thereby, the conversion device 10 is connected to the host 20 by the wire of the USB Type C.

The conversion device 10 is connected to the device 30 in accordance with a standard of USB Type A. That is, the conversion device 10 includes a second connection port 10*b* which is a connection port of the USB Type A, and the device 30 includes a connection port 30*b* of the USB Type A. Hence, one connector of the USB Type A which is included in a wire of the USB Type A is connected to the second connection port 10*b*, and the other connector is connected to the connection port 30*b*, and thereby, the conversion device 10 is connected to the device 30 by the wire of the USB Type A.

Furthermore, the conversion device 10 is connected to the device 30 by a power line. That is, the conversion device 10 includes a third connection port 10*c* which is a connection port of a power supplying wire, and the device 30 includes a connection port 30*a* of the power supplying wire. Hence, one connector of the power supplying wire is connected to the third connection port 10*c* of the conversion device 10, the other connector is connected to the connection port 30*a*, and thereby, power can be supplied from the conversion device 10 to the device 30.

(1-1) Configuration of Conversion Device

Figure 1B:
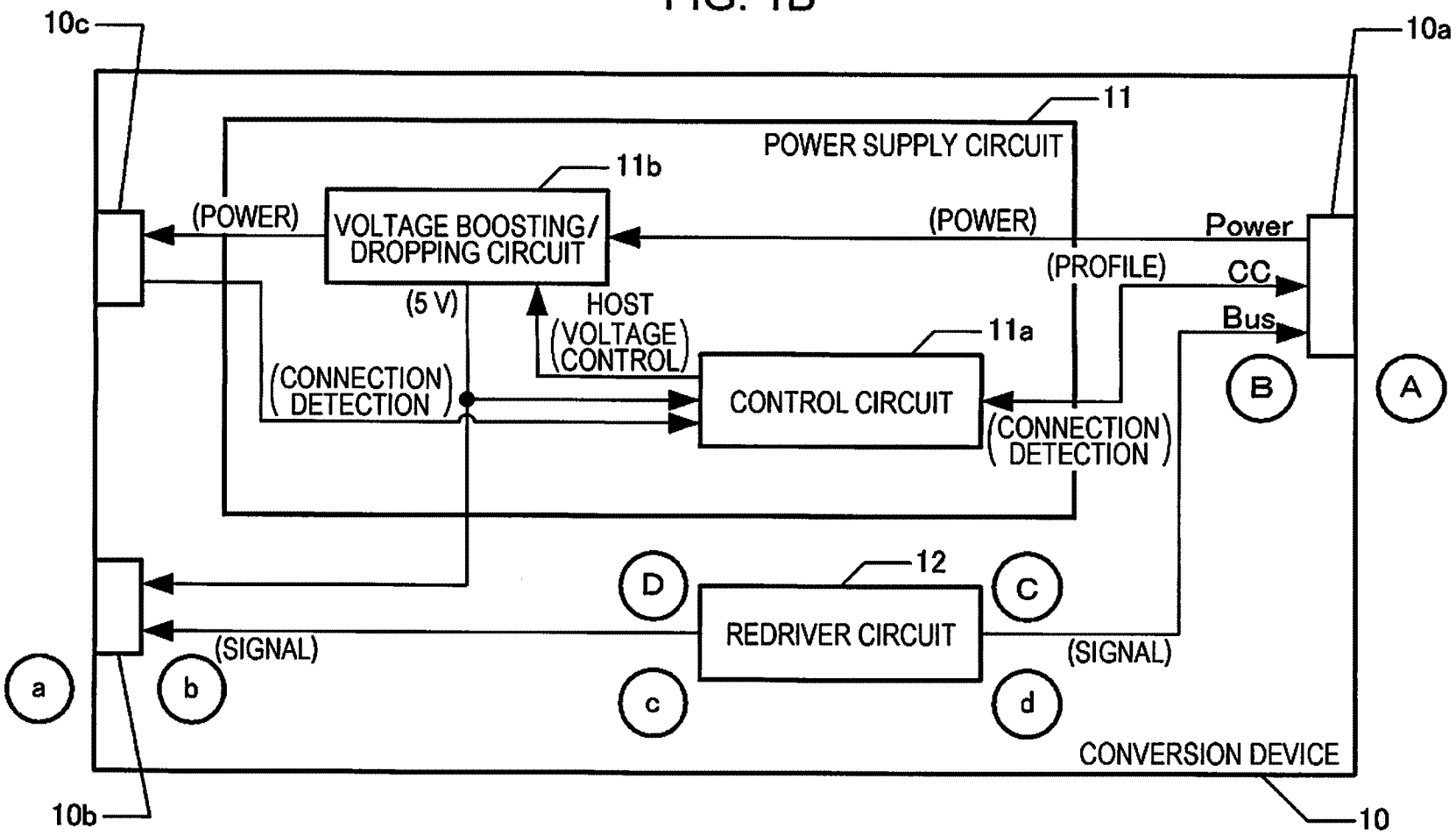
FIG. 1B is a diagram illustrating a configuration of the conversion device.

FIG. 1B is a diagram illustrating a configuration of the conversion device 10 that is used together with the host 20 and the device 30 which can perform communication corresponding to a SuperSpeed standard. The conversion device 10 includes a power supply circuit 11 and a redriver circuit 12. The power supply circuit 11 has a function of generating power which is supplied to the device 30 connected to the third connection port 10*c*, based on the power which is supplied from the host 20 connected to the first connection port 10*a*, and includes a control circuit 11*a* and a voltage boosting/dropping circuit 11*b*.

The control circuit 11*a* includes a wire which is connected to the first connection port 10*a* (by a CC pin), and wires which are connected to the voltage boosting/dropping circuit 11*b* and the third connection port 10*c*. The control circuit 11*a* is a circuit (for example, circuit including a CPU, a RAM, a ROM, and the like) which performs a predetermined function in accordance with a predetermined order. The control circuit 11*a* can detect whether or not a connector is inserted into the third connection port 10*c* through a wire connected to the third connection port 10*c*.

Furthermore, the control circuit 11*a* can output profile data of power to the host 20 through the wire connected to the first connection port 10*a*. That is, in the present embodiment, a storage medium (not illustrated) included in the control circuit 11*a* stores the profile data in accordance with a required specification of the device 30 in advance. If the control circuit 11*a* outputs the profile data to the first connection port 10*a*, the host 20 connected to the first connection port 10*a* acquires the profile data. Then, the host 20 outputs power that the profile data indicates from the connection port 20*a*. As a result, power is input from the first connection port 10*a* through the wire of the USB Type C, and is supplied to the voltage boosting/dropping circuit 11*b*.

Hence, according to the present embodiment, it is possible to supply the profile data that the host 20 of the USB Type C usually requires to perform power supplying (Power Delivery) from the conversion device 10. Accordingly, although the device 30 does not support the standard of USB Type C (Power Delivery), the device 30 can instruct the conversion device 10 to output the power to the host 20.

In the embodiment, the profile data is defined according to the required specification of the device 30, a configuration is provided in which a voltage closest to a voltage defined in the required specification of the device 30 is output from the host 20 and loss of voltage conversion of the voltage boosting/dropping circuit 11*b* which will be described below is prevented. For example, in a case where a voltage defined in the required specification of the device 30 is 48 V, the profile is defined in advance such that 20 V which is an upper limit value of a voltage is output from the host 20, and the profile is stored in the control circuit 11*a*.

Furthermore, the control circuit 11*a* is connected to the voltage boosting/dropping circuit 11*b* by a communication line and a power line, and the control circuit 11*a* can output a control signal instructing an output or the like of power (for example, value of voltage) to the voltage boosting/dropping circuit 11*b* through the communication line. In addition, the control circuit 11*a* receives power (DC power of 5 V in the present embodiment) for driving the control circuit 11*a* through the power line of the voltage boosting/dropping circuit 11*b*.

The voltage boosting/dropping circuit 11*b* generates power of a voltage stored in response to the profile data, based on the power supplied from the host connected to the first connection port 10*a*. In the present embodiment, the voltage boosting/dropping circuit 11*b* includes a wire which is connected to the first connection port 10*a* (by a Power pin), a wire which is connected to the third connection port 10*c*, and a wire which is connected to the control circuit 11*a*.

The voltage boosting/dropping circuit 11*b* generates power in which a voltage is boosted or dropped based on the power that is input through the wire connected to the first connection port 10*a*. In the present embodiment, a voltage or the like of the output power is determined based on an instruction from the control circuit 11*a*. In the present embodiment, a storage medium (not illustrated) included in the control circuit 11*a* stores a required specification of power of the device 30 in advance.

In a case where the power which is supplied from the first connection port 10*a* on the basis of the profile data is different from the power that the device 30 requires, the control circuit 11*a* instructs the voltage boosting/dropping circuit 11*b* to generate the latter power from the former power. As a result, the voltage boosting/dropping circuit 11*b* generates power according to the required specification of the device 30 from, for example, an input voltage. In a case where the power which is supplied from the first connection port 10*a* on the basis of the profile data is equal to the power that the device 30 requires, the voltage boosting/dropping circuit 11*b* does not convert a voltage.

In the embodiment, the control circuit 11*a* can instruct the voltage boosting/dropping circuit 11*b* to start output of power. As described above, the control circuit 11*a* functions as a connection detecting circuit which detects whether or not a connector is connected to the third connection port 10*c*, and thus, if the control circuit 11*a* detects that the connector is connected to the third connection port 10*c*, the control circuit 11*a* instructs the voltage boosting/dropping circuit 11*b* to start output of power. As a result, power is supplied to the device 30 connected to the third connection port 10*c* through the connector connected to the third connection port 10*c* and the wire extending from the connector. According to the configuration, it is possible to prevent a voltage from being applied to the third connection port 10*c* in a state where a wire which has to receive power is not connected to the conversion device 10.

In addition, according to the aforementioned configuration, it is possible to output power according to the required specification of the device 30 from the conversion device 10. In addition, even in a case where the required specification of the power of the device 30 exceeds the specification of USB Type C (for example, in a case where a voltage value exceeds 20 V which is an upper limit value of USB Type C), the conversion device 10 can supply the power of the specification that the device 30 requires. The voltage boosting/dropping circuit 11*b* can generate DC power of a default voltage (5 V in the present embodiment), based on the power which is input through the wire connected to the first connection port 10*a*, and output the voltage. The generated power is supplied to the control circuit 11*a* and the second connection port 10*b*.

The redriver circuit 12 is connected to the first connection port 10*a* and the second connection port 10*b* through communication lines, and shapes a waveform of a signal which is transmitted from the first connection port 10*a* to the second connection port 10*b* (or transmitted from the second connection port 10*b* to the first connection port 10*a*). It is preferable that the redriver circuit 12 be applied to a signal whose frequency is high and frequency loss cannot be neglected, for example, a signal defined by a SuperSpeed standard.

Figure 1C:
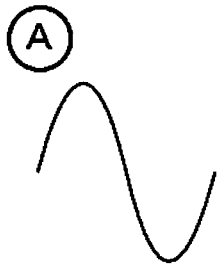
FIG. 1C to FIG. 1F are diagrams illustrating examples of a waveform of a signal.
Figure 1D:
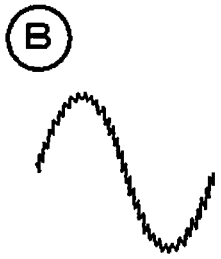
Figure 1E:
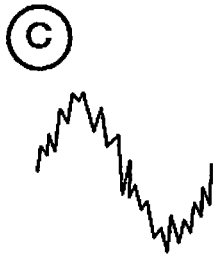
Figure 1F:
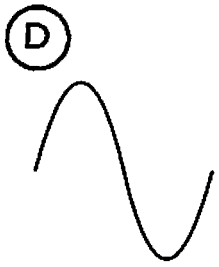

Specifically, in a case where a high frequency signal with a waveform illustrated in FIG. 1C is input to an A side of the first connection port 10*a* illustrated in FIG. 1B from the host 20, the signal can have a waveform illustrated in FIG. 1D on a B side of the first connection port 10*a* illustrated in FIG. 1B and a waveform of the signal can collapse like the waveform illustrated in FIG. 1E immediately before (on a C side illustrated in FIG. 1B) the redriver circuit 12, and such a change of the waveform of the signal is noticeable in a high frequency signal. However, if the redriver circuit 12 illustrated in FIG. 1B exists, a signal which is deformed as illustrated in FIG. 1E can be shaped as a waveform illustrated in FIG. 1F to be output on a D side of FIG. 1B.

Meanwhile, in a case where a high frequency signal with a waveform illustrated in FIG. 1C is input to an a side of the second connection port 10*b* illustrated in FIG. 1B from the device 30, the signal can have a waveform illustrated in FIG. 1D on a b side of the second connection port 10*b* illustrated in FIG. 1B and a waveform of the signal can collapse like the waveform illustrated in FIG. 1E immediately before (on a c side illustrated in FIG. 1B) the redriver circuit 12, and such a change of the waveform of the signal is noticeable in a high frequency signal. However, if the redriver circuit 12 illustrated in FIG. 1B exists, a signal which is deformed as illustrated in FIG. 1E can be shaped as a waveform illustrated in FIG. 1F to be output on a d side of FIG. 1B. Hence, according to the present embodiment, a signal defined by the SuperSpeed standard that is a high frequency signal can be appropriately transmitted between the host 20 and the device 30, and thereby, appropriate communication can be performed.

As described above, the conversion device 10 can relay communication between the device 30 and the host 20 which are connected to the second connection port 10*b*. Hence, the conversion device 10 can perform communication between the host 20 which uses the USB Type C and the device 30 which uses the USB other than the USB Type C. In addition, the conversion device 10 can supply power from the host 20 to the device 30 connected to the third connection port 10*c*, and can supply power to the device 30 without using an AC adapter or the like. In addition, the conversion device 10 converts power supplied from the host 20 into power which can be used for the device 30, and thus, even in a case where standards of the USB for the host 20 and the device 30 are different from each other, power can be supplied from the host 20 to the device 30. For this reasons, according to the conversion device 10, compatibility between a plurality of standards can be secured.

(2) Processing of Control Circuit

Figure 2A:
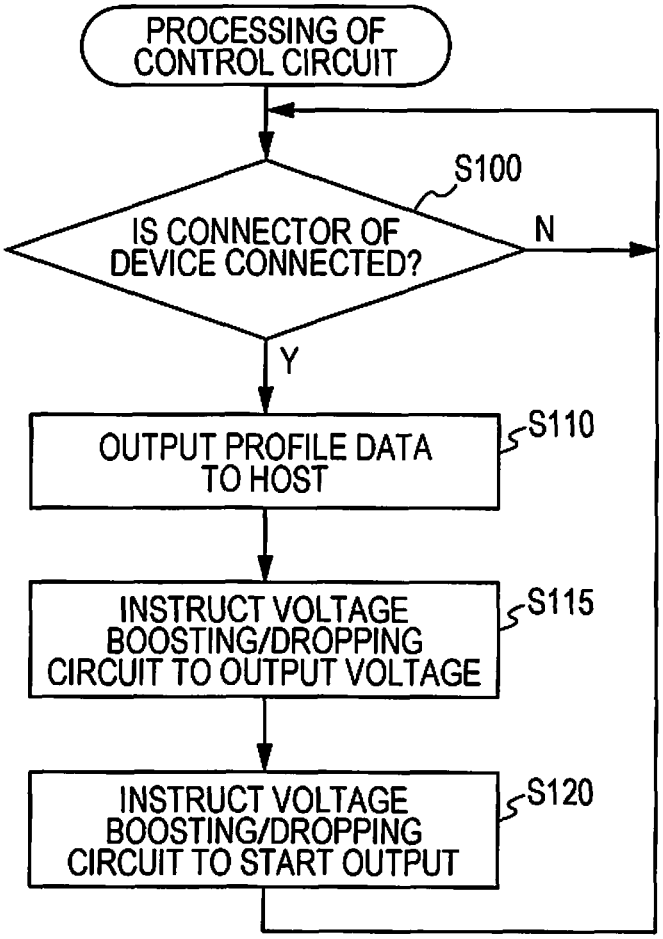
FIG. 2A is a flowchart of a control circuit.

FIG. 2A is a flowchart illustrating processing of the control circuit 11*a*. In the present embodiment, the host 20 is connected to the conversion device 10, default power is supplied from the host 20 through the first connection port 10*a*, DC power of 5 V is supplied from the voltage boosting/dropping circuit 11*b* to the control circuit 11*a*, based on the power, and thereby, the control circuit 11*a* starts processing illustrated in FIG. 2A. In addition, here, it is assumed that an example is used in which DC power of 48 V is defined as the required specification of the power of the device 30.

In the processing, the control circuit 11*a* detects whether or not a connector of the device 30 is connected to the third connection port 10*c* (step S100). In step S100, in a case where it is not determined that the connector of the device 30 is connected to the third connection port 10*c*, the control circuit 11*a* repeats determination of step S100 at a constant time.

In step S100, in a case where it is determined that the connector of the device 30 is connected to the third connection port 10*c*, the control circuit 11*a* outputs the profile data to the host 20 with reference to a storage medium which is not illustrated (step S110). If the host 20 acquires the profile data, the host 20 outputs power that the profile data indicates to the conversion device 10. In the present example, the device 30 requires DC power of 48 V, and thus, the profile data indicates power (5 A) of 20 V that is an upper limit voltage. Hence, if the host 20 acquires the profile data, DC power of 20 V and 5 A is supplied to the first connection port 10*a* through a wire of USB Type C.

Subsequently, the control circuit 11*a* instructs the voltage boosting/dropping circuit 11*b* to output a voltage (step S115). That is, the control circuit 11*a* outputs a control signal to the voltage boosting/dropping circuit 11*b* such that power according to the required specification of the device 30 is output, with reference to the storage medium which is not illustrated. For example, in an example in which the device 30 requires DC power of 48 V, the control circuit 11*a* instructs the voltage boosting/dropping circuit 11*b* to output the DC power of 48 V. As a result, the voltage boosting/dropping circuit 11*b* generates power according to the required specification of the device 30.

Subsequently, the control circuit 11*a* instructs the voltage boosting/dropping circuit 11*b* to start output (step S120). As a result, the voltage boosting/dropping circuit 11*b* outputs power according to the required specification of the device 30 from the third connection port 10*c*. Subsequently, the control circuit 11*a* repeats processing subsequent to step S100. However, step S100 is repeatedly performed, in a case where it is not determined that the connector of the device 30 is connected to the third connection port 10*c*, that is, in a case where the connector of the third connection port 10*c* is pulled out, the control circuit 11*a* stops conversion of the power and output of the power of the voltage boosting/dropping circuit 11*b*, and repeats the processing of step S100.

(3) Another Embodiment

The aforementioned embodiment is an example for performing the invention, and, as long as the conversion device has a configuration in which communication lines of the USB according to standards different from each other are connected and power is transmitted and received through a power line of the USB according to one standard, various other embodiments can be employed.

Figure 2B:
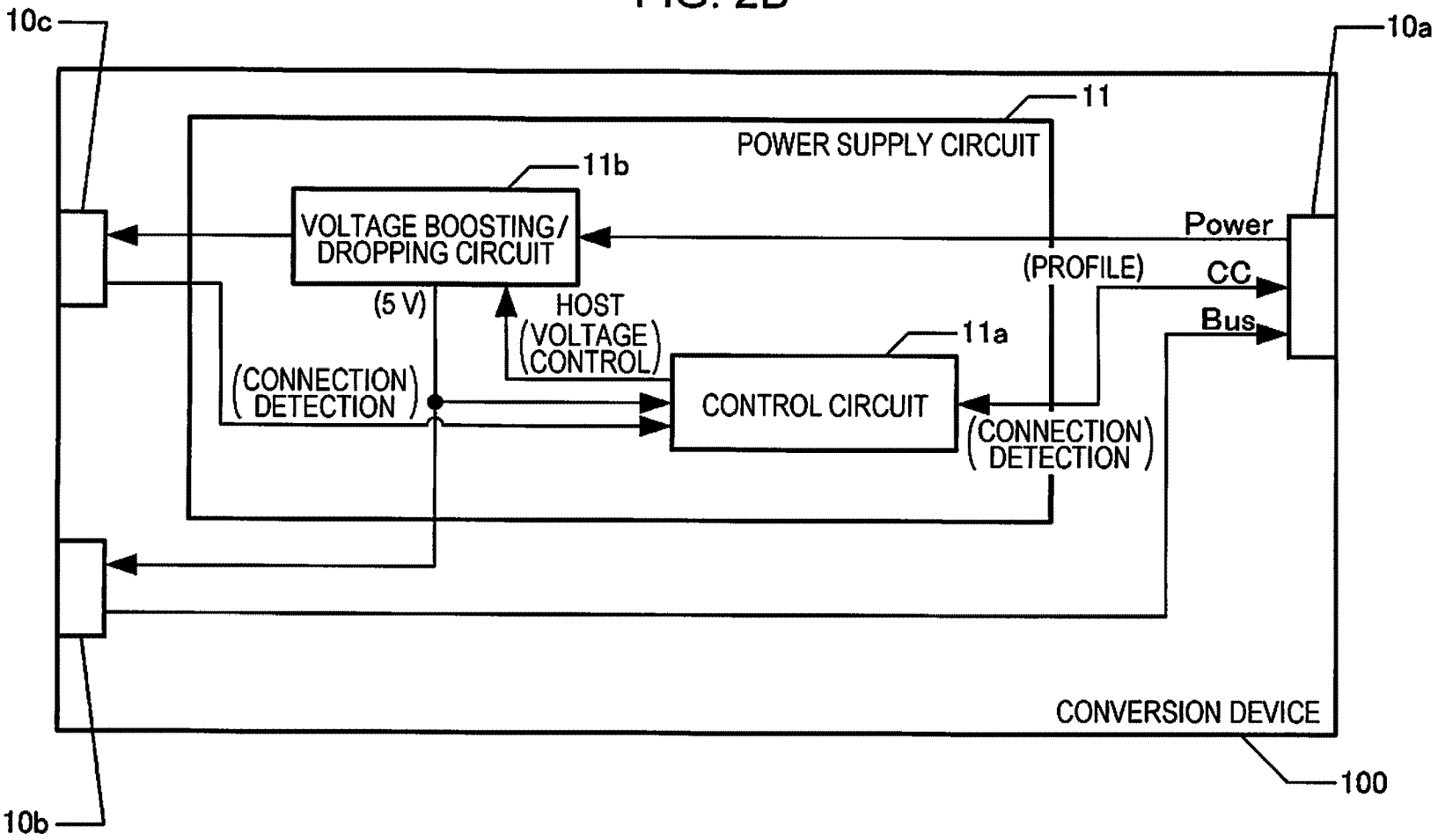
FIG. 2B is a diagram illustrating a configuration of another conversion device.

For example, the conversion device 10 includes the redriver circuit 12, but if a signal to be transmitted is a signal which can neglect influence of high frequency loss, for example, a signal according to a High Speed standard, the redriver circuit 12 can be omitted. FIG. 2B illustrates a configuration of a conversion device 100 which is configured by omitting the redriver circuit 12 from the conversion device 10 illustrated FIG. 1B. In the configuration illustrated in the FIG. 2B, configuration elements to which the same symbols or reference numerals as those illustrated in FIG. 1B are attached have the same configuration as the configuration elements illustrated in FIG. 1B.

As such, although the redriver circuit 12 is omitted, a signal can be transmitted without shaping a waveform as long as the signal is a low frequency signal. Hence, as illustrated in FIG. 2B, power which is supplied from the host 20 is converted according to necessity to be supplied to the device 30 by using the power supply circuit 11 in the same manner as in FIG. 1B, and thereby, it is possible to provide the conversion device 100 which can secure compatibility between a plurality of standards.

Furthermore, a first connection port may be a connection port of the USB Type C. Hence, a shape or a terminal of an insertion portion of a connector may be disposed such that a connector of the USB Type C is connected and thereby communication is performed (power may be able to be transmitted and received). Alternatively, a direct connection to a connection port of USB Type C of the host 20 may be performed without passing through a cable.

A second connection port may be a connection port of the USB other than the USB Type C. Hence, a shape or a terminal of an insertion portion of the connector may be disposed such that a connector according to a USB standard other than USB Type C is connected, and thereby, communication and transmission/reception of power can be performed. For example, the USB Type A or B, the mini-USB Type A, B or AB, micro-USB Type A, B, or AB, or the like can be used as the USB standard other than the USB Type C. In addition, a direct connection to a connection port of the USB of the device 30 may be performed without passing through a cable.

A third connection port may be a connection port of a power supplying wire. That is, power may be able to be transmitted and received between an electronic apparatus and a conversion device which are connected to the connection port. A shape or a terminal of the third connection port can have aspects according to various standards. A direct connection to the connection port of the power supplying wire of the device 30 may be performed without passing through a cable.

A communication wire may be able to connect a communication line between the first connection port and the second connection port. That is, a wire may be formed such that communication is performed between an electronic apparatus of the USB Type C connected to the first connection port and an electronic apparatus of the USB other than the USB Type C connected to the second connection port. Of course, the communication wire may include various circuits, for example, a redriver (repeater) circuit or the like which shapes a waveform of a signal for communication according to the SuperSpeed standard or the like.

The power wire may be able to connect a power line between the first connection port and the third connection port. That is, the wire may be formed such that power is transmitted and received between the electronic apparatus of the USB Type C connected to the first connection port and the electronic apparatus connected to the third connection port. Of course, the power wire may include various circuits such as a power supply circuit for generating power according to specifications (voltage, current, and the like) of power necessary for the electronic apparatus connected to the third connection port. In addition, as long as the host 20 can supply power according to the specification of the power that the device 30 requires, the first connection port may be directly connected to the third connection port through a power line, and may pass through only a switch which switches ON/OFF of supplying of power, without using the voltage boosting/dropping circuit 11*b*.

Specifically, the power wire can employ a configuration including a power supply circuit which generates power that is supplied to a device connected to the third connection port, based on power supplied from the host connected to the first connection port. According to the configuration, a conversion device converts power supplied from the host into power which can be used for the device, and thus, it is possible to supply power from the host to the device, even in a case where standards of the USB for the host and the device are different from each other.

Furthermore, a configuration may be provided in which the power supply circuit outputs profile data of power the host through a wire connected to the first connection port. According to the configuration, it is possible to supply the profile data that the host of the USB Type C usually requires to perform power supplying (Power Delivery) from a conversion device. Accordingly, although the device does not support the standard of USB Type C (Power Delivery), the device can instruct the conversion device to output power to the host.

The profile data may be stored in a storage medium included in the conversion device, default profile data may be stored, and the profile data may be able to be rewritten based on an operation of a user, communication with the device, or the like. For example, in the aforementioned configuration illustrated in FIG. 1B, the control circuit 11*a* or the like is configured to include a rewritable EEPROM or the like, and the EEPROM or the like is configured to store profile data. In the configuration, if the profile data can be rewritten based on an operation of a user, instruction of an electronic apparatus connected to the conversion device 10, or the like, it is possible to provide the conversion device 10 corresponding to various devices 30.

Furthermore, the power supply circuit may include a voltage boosting/dropping circuit which generates power of a voltage stored corresponding to the profile data, based on the power supplied from the host connected to the first connection port. According to the configuration, even in a case where the required specification of the power of the device exceeds the specification of USB Type C (for example, in a case where a voltage value exceeds 20 V that is an upper limit of the standard of the USB Type C), it is possible to supply power of a specification that the device requires from a conversion device. The required specification of the power that the device requires may be stored in a storage medium that the conversion device includes, default required specification may be stored, and the required specification may be able to rewritten, based on an operation of a user, communication of a device, or the like. In addition, a voltage according to an input may be generated by inputting a type of a device which is connected to a user or a voltage value which is output, by providing a switch to the conversion device 10, or the like.

Furthermore, the power supply circuit may include a configuration in which a connection detecting circuit which detects whether or not a connector is connected to the third connection port is provided and when the connection detecting circuit detects that the connector is connected to the third connection port, the power supply circuit starts supplying of power to the third connection port. According to the configuration, it is possible to prevent a voltage from being applied to the third connection port in a state where a wire which has to receive power is not connected to the conversion device.

Furthermore, as described above, a technology of transmitting and receiving power by using a power line of the USB according to one standard in a state where communication lines of the USB according to different standards are connected to the conversion device can also be realized as a method.

What is claimed is:

1. A conversion device comprising:

a first connection port that is a connection port of a USB Type C;

a second connection port that is a connection port of a USB other than the USB Type C;

a third connection port that is a connection port of a power supplying wire;

a communication wire that is connected to a communication line between the first connection port and the second connection port; and a power supply circuit that receives power from a host through the first connection port and transmits power to a device through the third connection port, the power supply circuit transmitting profile data of power to the host trough a wire that is connected to the first connection port, and receive power from the host according to the profile data after transmitting the profile data.

2. The conversion device according to claim 1, wherein the power supply circuit includes a voltage boosting/dropping circuit that transforms power that is supplied from the host which is connected to the first connection port to a voltage which is stored corresponding to the profile data.

3. The conversion device according to claim 1, wherein the power supply circuit includes a connection detecting circuit that detects whether or not a connector is connected to the third connection port, and starts supplying of power to the third connection port in a case where the connection detecting circuit detects that the connector is connected to the third connection port.

4. The conversion device according to claim 1, wherein the communication wire includes a redriver circuit which shapes a waveform of a communication signal that is transmitted through the communication line separately from the power.

5. The conversion device according to claim 1, wherein the redriver circuit shapes a waveform of a communication signal defined by SuperSpeed standard.

6. The conversion device according to claim 1, wherein the power supply circuit includes a storage medium that stores the profile data corresponding the device in advance, and transmits to the host the profile data that is retrieved from the storage medium in response to a connection of the device to the third connection port.

* * * * *